US006722288B2

(12) United States Patent
Beers

(10) Patent No.: US 6,722,288 B2
(45) Date of Patent: Apr. 20, 2004

(54) RAILWAY BOX CAR WITH LOWER CENTER OF GRAVITY

(75) Inventor: Albert A. Beers, Duncanville, TX (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 10/136,128

(22) Filed: May 1, 2002

(65) Prior Publication Data

US 2002/0170459 A1 Nov. 21, 2002

Related U.S. Application Data

(60) Provisional application No. 60/288,116, filed on May 2, 2001.

(51) Int. Cl.[7] ..... B61F 1/00

(52) U.S. Cl. ..... 105/413; 105/416; 105/418; 105/419; 105/420

(58) Field of Search ..... 105/355, 413, 105/414, 416, 417, 418, 419, 420, 421, 422, 404, 396, 397

(56) References Cited

U.S. PATENT DOCUMENTS 379,978 A * 3/1888 Plattenburg ..... 105/413
953,116 A * 3/1910 Bettendorf ..... 105/415
970,128 A * 9/1910 Shallenberger ..... 105/415
1,016,165 A * 1/1912 Magor ..... 105/416
1,146,589 A * 7/1915 Fowler ..... 452/77
1,178,494 A * 4/1916 Clasen ..... 105/416
2,669,193 A * 2/1954 Osborn ..... 105/422
2,783,718 A 3/1957 Cheshire ..... 105/419
2,868,140 A * 1/1959 Shaver ..... 105/390
3,266,441 A 8/1966 Pulcrano ..... 105/416
4,562,633 A * 1/1986 Adams et al. ..... 29/401.1
5,855,174 A * 1/1999 Thoman et al. ..... 105/413
5,918,549 A * 7/1999 Basile et al. ..... 105/422

* cited by examiner

*Primary Examiner*—Mark T. Le
(74) *Attorney, Agent, or Firm*—Baker Botts L.L.P.

(57) ABSTRACT

A railway car having a lowered center of gravity is provided. The underframe of the railway car is preferably formed by extending a series of cross bearers between a pair of side sills and spacing them laterally between a pair of end sills. A center sill is then preferably disposed on top of the cross bearers and extended between the end sills along a center line of the railway car underframe. One or more floor stringers are preferably also included and disposed generally parallel to the center sill and extended between the end sills. In one embodiment, the one or more floor stringers may be disposed on stringer support spacer beams positioned on one or more of the cross bearers.

19 Claims, 2 Drawing Sheets

RAILWAY BOX CAR WITH LOWER CENTER OF GRAVITY

RELATED APPLICATIONS

This application claims the benefit of U.S. Provisional Application Serial No. 60/288,116 filed May 2, 2001.

TECHNICAL FIELD

The present invention relates generally to the construction of freight moving vehicles and, more particularly, to a railway car having a lowered center of gravity.

BACKGROUND OF THE INVENTION

Over the years, railway cars have progressed from relatively simple general purpose wooden structures mounted on flat cars to more elaborate arrangements including insulated walls, refrigeration equipment, nailable metal floors, and other features for specific applications. Various types of railway cars are presently manufactured and used. A typical railway freight car includes an enclosed structure mounted on a railway car underframe. The enclosed structure may include an outer shell and interior paneling. For some railway freight cars, such as refrigerated box cars, one or more layers of insulation may be disposed between the outer shell and the interior paneling.

The outer shell of a railway freight car often has an exterior surface formed from various types of metal such as steel or aluminum alloys. The interior paneling is often formed from wood and/or metal as desired for the specific application. Sliding doors are generally provided on each side of the enclosed structure for loading and unloading freight. Conventional railway freight cars may be assembled from various pieces of wood, steel and/or sheets of composite material such as fiberglass reinforced plastic and generally require significant amounts of raw material, labor and time to complete manufacture and assembly of each freight car.

The underframe for many railway freight cars includes a center sill with a pair of end sills and a pair of side sills arranged in a rectangular configuration corresponding approximately with the dimensions for the floor of the freight car. Cross bearers and cross ties are often provided to establish the desired rigidity and strength for transmission of vertical loads to the center sill. A plurality of longitudinal stringers are typically provided on each side of the center sill to support the floor of the enclosed structure. Examples of such railway car underframes are shown in U.S. Pat. Nos. 2,783,718 and 3,266,441. Both of these patents are incorporated by reference for all purposes within this application.

In the United States, the Association of American Railroads (AAR) controls the guidelines with which railway car manufacturers must comply when designing and building railway cars. The AAR guidelines dictate such design parameters as maximum lengths, widths, weights as well as many others.

In the interest of safety, the Association of American Railroads (AAR) has also established guidelines regarding the way in which railway cars may be loaded. One such guideline concerns the combined center of gravity of a railway car and its load. In this combined center of gravity guideline, the combined center of gravity of a railway car and its load is not to exceed ninety-eight inches (98") above the top of the rail. In general, when a shipping agent loads a railway car with lading for transportation, the shipping agent is required to calculate the combined center of gravity of the railway car and its contents whenever any part of the load exceeds one hundred forty inches (140") or eleven-feet and eight-inches (11'8") in height above the car floor.

The combined center of gravity of a railcar and its load may be defined as follows:

Combined Center of Gravity $$\text{Combined Center of Gravity } (CG) = \frac{[(B \times E) + (D \times F)]}{(E + F)} \qquad \text{Eq. 1}$$

In equation 1, 'A' is the measure of the height of the car floor above the top of the rail; 'B' is the center of gravity of the railcar when empty, 'C' is the center of gravity of the load above the car floor, 'D' is the height of the center of gravity of the load above the top of the rail and is equal to the sum of 'A' and 'C,' 'E' is the unloaded weight of the railcar and 'F' is the weight of the load.

As a result of the AAR guidelines regarding combined center of gravity height limitations, a shipping agent may be unable to use the full capacity of a given railway car when shipping certain ladings. For example, a paper mill wishing to ship rolls of paper may be unable to use the full capacity of a boxcar having a seventeen foot interior height without violating the AAR combined center of gravity guidelines. As such, many shipping agents are forced to resort to other methods of shipping such as trucking, to ship their goods in an economical manner.

To overcome the load limits resulting from the combined center of gravity limitations in the AAR guidelines, various methods have been attempted. One method for lowering the center of gravity on a railway car is commonly called ballasting. Ballasting of a railway car involves hanging a number of weights from one or more side sill channels on the railway car as close to the rails or railway tracks as possible to achieve as much lowering of the combined center of gravity as possible. One of the drawbacks of ballasting is the loss of load limit that results from having to add significant amounts of ballasting weight to achieve an appreciable lowering in the railway car's center of gravity.

SUMMARY OF THE INVENTION

In accordance with teachings of the present invention, a railway car underframe having a lowered center of gravity is provided. The railway car underframe of the present invention preferably includes a pair of end sills cooperating with a pair of side sills to form a generally rectangular configuration and a plurality of cross bearers extending between the side sills and spaced laterally from each other between the end sills. The underframe preferably also includes a center sill extending between the end sills along a center line of the rectangular configuration and disposed above at least one of the plurality of cross bearers. A pair of coupler assemblies disposed on respective ends of the rectangular configuration and a pair of railway trucks disposed at respective ends of the generally rectangular configuration proximate the end sills are also preferably included in the railway car underframe. A body bolster extending between the center sill and the side sills above each of the railway trucks and a bolster plate extending between the side sills above each of the body bolsters may also be included in the railway car underframe. A plurality of wheel pans extending from each body bolster and sized to extend over each wheel of the railway trucks are also preferably included in the railway car underframe having a lowered center of gravity of the present invention.

In an another embodiment, a railway car having first and second end sills disposed generally normal proximate respective ends of first and second side sills to form a generally rectangular configuration is provided. The railway car preferably includes a center sill disposed along a longitudinal center line of the rectangular configuration and a plurality of cross bearers extending between the side sills and spaced laterally from each other between the end sills. A pair of railway trucks disposed proximate the first and second end sills along with a body bolster extending between the center sill and the first and second side sills above each of the respective railway trucks are also preferably included. The railway car may include a bolster plate disposed above each body bolster and extending between the side sills and a plurality of wheel pans attached to and extending horizontally from each body bolster and sized to extend over the respective railway trucks. To form a part of the railway car's flooring, a plurality of floor stringers extending between the first and second end sills and the wheel pans and spaced laterally from each other between the center sill and the first and second side sills and a plurality of floor stringers extending longitudinally between the wheel pans above the respective railway trucks and spaced laterally from each other between the center sill and the first and second side sills, where the plurality of floor stringers disposed on at least one cross bearer, are also preferably included. As part of the railway car's flooring surface, a plurality of nailable metal floor planks extending between the center sill and the first and second side sills and spaced laterally from each other between the first and second end sills is provided. A pair of coupler assemblies disposed proximate the first and second end sills are also preferably included.

In a further embodiment, a railway car having a lowered center of gravity is provided. The railway car preferably includes a pair of end sills cooperating with a pair of side sills to form a generally rectangular configuration. A plurality of cross bearers extending between the side sills and spaced laterally from each other between the end sills is also preferably included. A center sill extending between the end sills on a longitudinal center line of the rectangular configuration and disposed on one or more of the plurality of cross bearers and a plurality of floor stringers extending between the end sills and spaced laterally from each other between the center sill and the side sills may also be included. One or more of the plurality of floor stringers are preferably disposed on one or more of the plurality of cross bearers. The railway car may further include a floor system disposed on the plurality of floor stringers and a pair of railway trucks disposed proximate each end sill. In addition, a body bolster extending between the center sill and the side sills above each of the railway trucks, a bolster plate disposed above each body bolster and extending between at least the center sill and the side sills and a plurality of wheel pans attached to and extending horizontally from each body bolster with the wheel pans sized to extend over the respective railway trucks are also preferably included in the railway car having a lowered center of gravity provided by the present invention.

One technical advantage of the present invention includes the ability to increase the amount of low density and/or lightweight lading that can be carried by a railway car without violating AAR center of gravity guidelines.

Another technical advantage of the present invention includes the lowering of a railway car's center of gravity without reducing the railway car's freight capacity.

An additional technical advantage of the present invention includes a modified railway car operable to accommodate various types of lading as well as loading configurations.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION OF THE INVENTION

Figure 1:
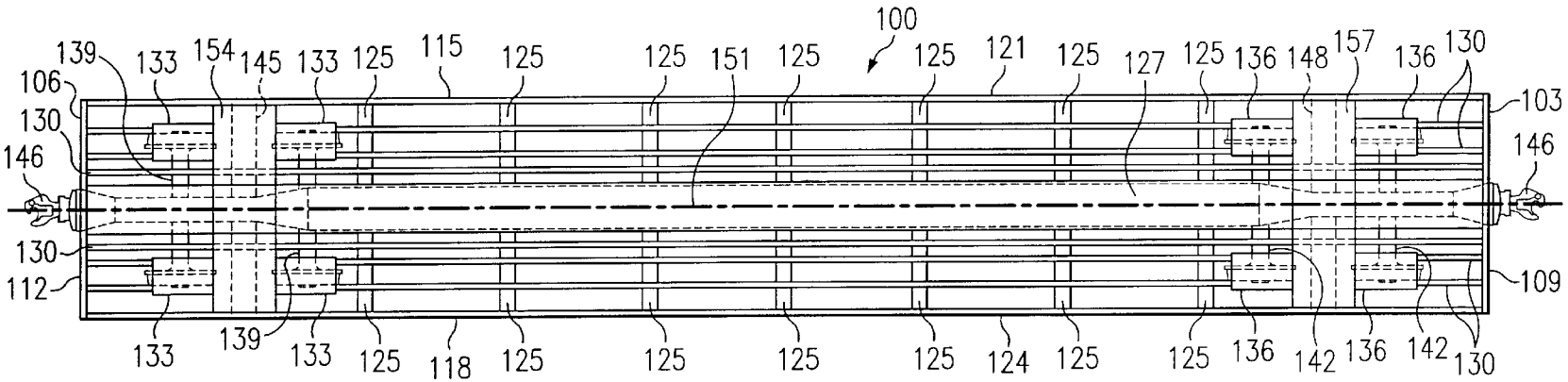
FIG. 1 is a plan view, partially in section, of a railway car underframe according to teachings of the present invention.

Preferred embodiments of the present invention and its advantages are best understood by referring to the drawings of FIGS. 1 through 4, where like numerals are used for like and corresponding parts of the various drawings.

Figure 2:
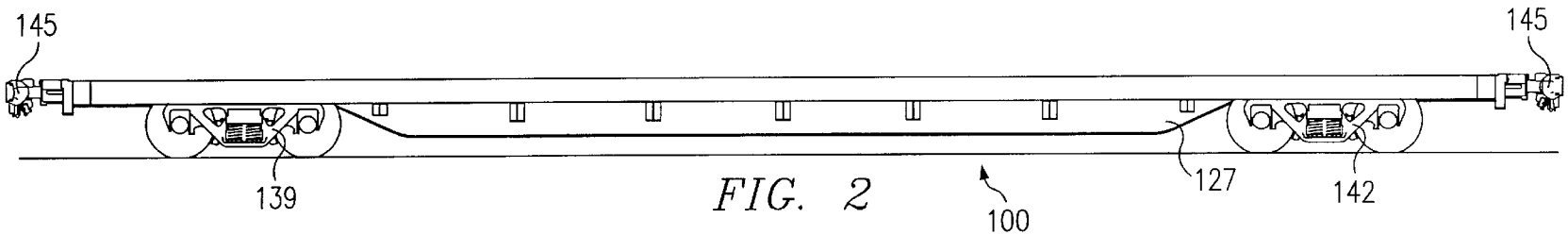
FIG. 2 is an elevation view of the railway car underframe of FIG. 1 according to teachings of the present invention.

Referring first to FIGS. 1 and 2, an example of a railway car underframe 100 incorporating teachings of the present invention is shown. Underframe 100 preferably includes first and second end sills 103 and 106, respectively, located at first and second ends 109 and 112, respectively, of underframe 100. First and second side sills 115 and 118, respectively, are preferably provided on first and second sides 121 and 124, respectively, of underframe 100. End sills 103 and 106 and side sills 115 and 118 preferably cooperate to form a generally rectangular sill arrangement.

Cross bearers 125 are provided to connect first and second side sills 115 and 118, respectively, with center sill 127. As will be discussed in greater detail below, one or more cross bearers 125 preferably extend below center sill 127 to connect first and second side sills 115 and 118, respectively.

Floor stringers 130 are also preferably included in underframe 100. Floor stringers 130 preferably provide support for a floor system (illustrated in FIG. 3) and extend longitudinally with respect to underframe 100. As illustrated, one or more floor stringers 130 may be included in underframe 100. Floor stringers 130 may extend the entire length of underframe 100 or, floor stringers 130 may be interrupted in the area of wheel pans 133 and 136.

First wheel pans 133 and second wheel pans 136 are preferably provided over first and second truck assemblies 139 and 142, respectively. Wheel pans 133 and 136 are typically mounted on center sill 127 of underframe 100 adjacent to and extending over first and second railway trucks 139 and 142, respectively, to protect the bottom of a floor system disposed thereon as well as any lading contained in or on the railway car. According to teachings of the present invention, first and second wheel pans 133 and 136, respectively, may be formed from a plurality of plates, preferably a high strength steel, approximately five-sixteenths of an inch (5/16") thick.

Underframe 100 also preferably includes first body bolster 145 disposed over first truck assembly 139 and second body bolster 148 disposed over second truck assembly 142. First and second body bolsters 145 and 148, respectively, preferably extend between center sill 127 and first and second side sills 115 and 118.

Bolster plates 154 and 157 are preferably included in underframe 100 above first and second body bolsters 145 and 148, respectively. Bolster plates 154 and 157 serve to protect the bottom of a floor system disposed thereon as well as any lading contained in or on the railway car from debris thrown by railway trucks 139 and 142. A pair of coupler assemblies 146 are preferably also provided at ends of 106 and 109 of underframe 100. Coupler assemblies 146 enable one or more railway cars to be coupled together.

Figure 3:
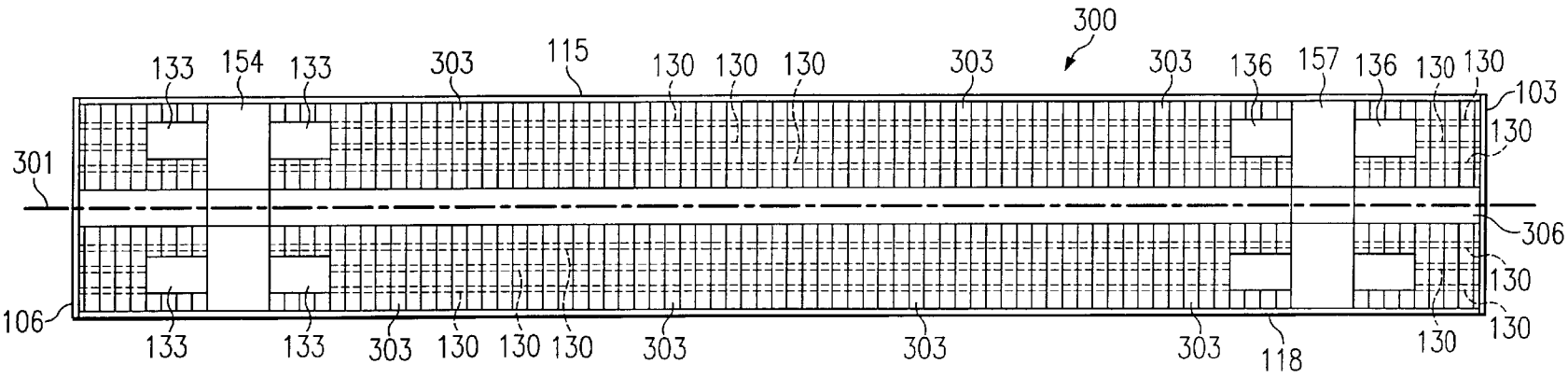
FIG. 3 is a schematic drawing, partially in section, showing one embodiment of a floor system incorporating teachings of the present invention.

Referring now to FIG. 3, a floor system incorporating teachings of the present invention is shown. In general, floor system 300 may be disposed on underframe 100. For purposes of illustrating various teachings of the present invention, floor system 300 will be described with respect to installation within a railway freight car or railway boxcar. However, the present invention may be satisfactorily used to form a floor structure in various types of vehicles or containers and is not limited to railway freight cars or railway car underframes.

During the assembly of a railway freight car or railway boxcar, the railway car underframe, such as underframe 100, is generally manufactured first and an enclosed structure mounted on the railway car underframe. Floor system 300, as shown in FIG. 3, may then be installed within the enclosed structure and attached to the railway car underframe. In the illustrated embodiment of FIG. 4, floor system 300 may be welded to selected portions of the railway car underframe. However, in alternative embodiments, floor system 300 and components thereof, may be bolted, attached with an adhesive, and/or coupled using any of various techniques employed in the railcar industry. A floor system incorporating teachings of the present invention may be easily modified for use with a wide variety of railway car underframes and various types of railway freight cars and box cars, while satisfying appropriate structural design requirements of the AAR.

For the embodiment of the present invention shown in FIG. 3, floor system 300 has a generally rectangular configuration with an overall length of approximately 60.5 feet and a width of approximately 9.5 feet. The various dimensions shown on the drawings are for only one embodiment of the present invention, and are not limitations on the scope of the invention. The present invention may allow various floor panels, including floor plates and reinforcing members, to be fabricated such that when assembled with each other, the dimensions and configurations of the resulting floor structure will be compatible with the requirements of the associated railway car underframe and enclosed structure.

Illustrated in FIG. 3 is a railway car underframe incorporating teachings of the present invention and having a floor system 300 disposed thereon. Center line 301 of floor system 300 corresponds generally with the center line of an associated railway car and center line 151 of underframe 100 illustrated in FIGS. 1 and 2. Floor system 300 includes a plurality of nailable metal floor planks 303 extending between center sill 127 and first and second side sills 115 and 118, respectively. Nailable metal floor planks 303 may be made from such materials as steel, steel alloys or a material having similar material strength characteristics. As such, nailable metal floor planks 303 are approximately four feet (4') in length. Nailable metal floor planks 303 are preferably spaced laterally from one another between first and second end sills 103 and 106, respectively, such that there is a nailing grove at approximately eight inch (8") intervals there between. Accordingly, the number of nailable metal floor planks 303 required to cover the entire flooring area of floor system 300 will vary and depend upon the length of flooring to be formed and the railway car underframe 100 used.

Floor system 300 of the illustrated embodiment may be referred to as a nailable metal floor. It should be recognized by those of ordinary skill in the art that the teachings of the present invention may include any one of several flooring systems available within the railcar industry. Such flooring systems include, but are not limited to, any type of nailable floor, flat reinforced floor panels, steel plate flooring and/or wood plank flooring.

Disposed between nailable metal floor planks 303 and extending between first and second end sills 103 and 106, respectively, above center sill 127 is strength plate 306. Strength plate 306 may be made from steel or a material having similar characteristics and uses. Strength plate 306 preferably engages offsets (illustrated in FIG. 4) included in the ends of nailable metal floor planks 303 disposed proximate center sill 127 such that the nailable metal floor planks 303 may be maintained in place once installed. Incorporation of strength plate 306 into floor system 300 preferably also creates a generally smooth flooring surface between first and second side sills 115 and 118, respectively.

According to teachings of the present invention, lowering the floor of a railway car contributes to an overall lowering of the railways car's center of gravity. As such, one of the advantages of the present invention includes lowering of a railway car's center of gravity without the use of additional weight and, therefore, without a loss of load capacity.

Floor system 300 generally lowers the railway car's floor to its lowest practical point. The minimum distance between a railway car floor and the wheel flange (not expressly shown) of wheels provided by railway trucks 139 and 142 is approximately five inches (5") according to AAR specifications. In pursuit of this goal, first wheel pans 133 are preferably disposed above the wheels of first railway trucks 139 of underframe 100. Similarly, second wheel pans 136 are preferably disposed above the wheels of second railway trucks 142 of underframe 100.

First and second wheel pans 133 and 136, respectively, are preferably formed from five-sixteenths of an inch (5/16") thick steel plates. Other thickness and material combinations may be employed without departing from the spirit and scope of the present invention. First and second wheel pans 133 and 136, respectively, are preferably sized to accept loads from floor system 300 and to transfer these loads to center sill 127. In addition, first and second wheel pans 133 and 136, respectively, may also protect adjacent portions of floor system 300 from debris thrown from railway trucks 139 and 142.

Bolster plates 154 and 157 also preferably form a portion of floor system 300, Bolster plates 154 and 157 preferably align with the upper surface of nailable metal floor planks 303 and wheel pans 133 and 136. Similar to wheel pans 133 and 136, bolster plates 154 and 157 are preferably made form a high strength steel and are approximately five-sixteenths of an inch (5/16") thick. Other embodiments of bolster plates 154 and 157 are considered within the spirit and scope of the present invention.

In the embodiment of floor system 300 illustrated in FIG. 3, a series of modified or shortened, nailable metal floor planks 303 may be included proximate first and second wheel pans 133 and 136, respectively. As such, a series of modified nailable metal floor planks 303 may be positioned to extend between first and second wheel pans 133 and 136, respectively, and first and second side sills 115 and 118, respectively. In addition, a series of modified nailable metal floor planks 303 may be disposed between first and second wheel pans 133 and 136 plates, respectively, and center sill 127. Alternative structures, such as expanded wheel pans, may be employed as a flooring surface above railway trucks 139 and 142 without departing from the spirit and scope of the present invention.

Figure 4:
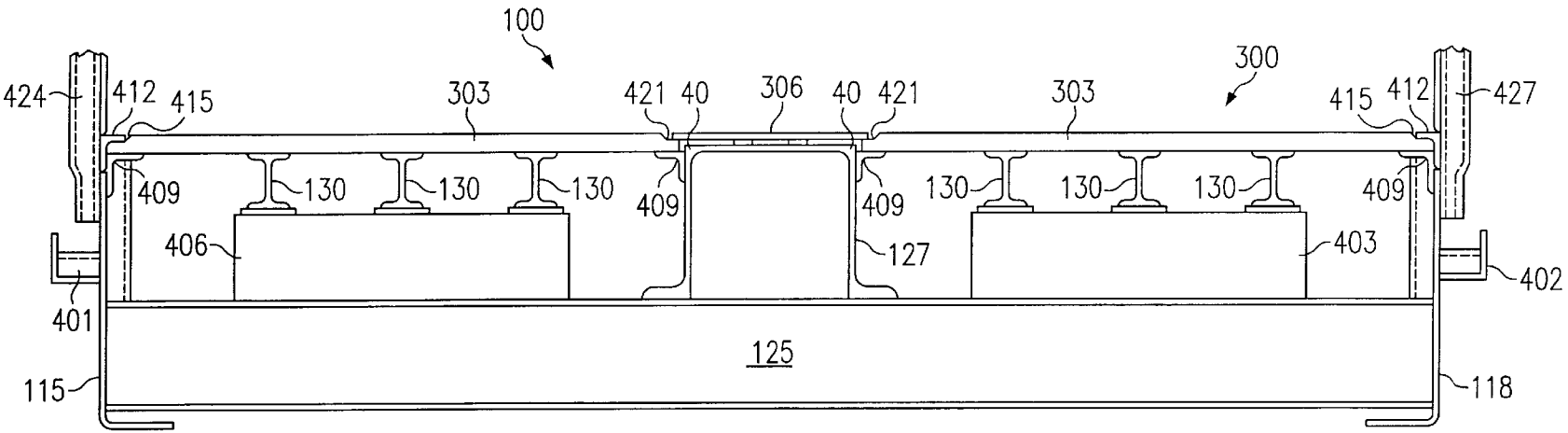
FIG. 4 is a partial cross-sectional view of a floor system and underframe assembly according to teachings of the present invention.

Illustrated in FIG. 4 is a partial, cross-sectional view of a floor system and underframe assembly according to teachings of the present invention. As illustrated, floor system 300 and underframe 100 may be combined to form a railway car having a lowered center of gravity.

Underframe 100 preferably includes first and second side sills 115 and 118, respectively. In one embodiment, side sill channels 401 and 402 may be included on side sill 115 and 118. Side sill channels enable one or more ballasting weights (not expressly shown) to be added to a railway car to further lower its center of gravity. In a further embodiment, one or more boxcar walls 424 and 427 may be coupled to side sills 115 and 118 as well as end sills 103 and 106 to form an enclosed railway boxcar.

Serving in part as a support for underframe 100 and floor system 300 is cross bearer 125. Cross bearer 125, in the embodiment illustrated in FIG. 4, preferably couples first and second side sills 115 and 118, respectively. Cross bearers 125 may be of a variety of types. For example, cross bearers 125 may be of the solid beam variety, the plate 'F' variety, as well as others. By increasing the weight of cross bearers 125, the center of gravity of a given railway car may be further lowered.

As mentioned above, one or more cross bearers 125 are preferably disposed below center sill 127. Moving cross bearers 125 from a typical position adjacent to an associated center sill to below center sill 127 lowers the railway car's center of gravity by moving portions of the railway car's weight closer to the rail. Depending upon the desired center of gravity for a railway car being manufactured, some cross bearers 125 may be positioned beneath center sill 127 in accordance with the present invention and some cross bearers may be extended between center sill 127 and side sills 115 and 118. As such, alternative placements of cross bearer 125 are considered within the scope of the present invention.

In part to provide support for floor system 300, stringer support spacer beams 403 and 406 may be disposed on one or more cross bearers 125. In such an embodiment, floor stringers 130, preferably included in underframe 100, may be disposed on stringer support spacer beams 403 and 406. As discussed above, floor stringers 130 travel generally longitudinally, along the length of underframe 100. In an alternate embodiment, stringer support spacer beams 403 and 406 may be omitted and replaced by floor stringers 130 having a height adequate to reach between nailable metal floor plank 303 and cross bearers 125.

Floor system 300 is preferably disposed on top of floor stringers 130 and between first and second side sills 115 and 118. Nailable metal floor planks 303 are generally supported by floor stringers 130. Additional support may be provided to nailable metal floor planks 303 using brackets 409. Brackets 412 may also be used to maintain nailable metal floor planks 303 in place by coupling brackets 412 to offset 415 disposed on a first end of nailable metal floor planks 303 and strength plate 306 to offset 421 disposed on a second end of nailable metal floor planks 303.

In one embodiment, stringer support spacer beams 403 and 406 are solid beams having substantial weight. By using stringer support spacer beams having substantial weight, the center of gravity of a railway car employing teachings of the present invention may be further lowered. Such lowering of a railway car's center of gravity enables lading to be stacked higher within or upon the railway car without the loaded railway car exceeding AAR guidelines. Enabling lading to be stacked higher within a railway car enables a railway car's load capacity to be better utilized.

Although the present invention and its advantages have been described in detail, it should be understood that various changes, substitutions and alterations can be made herein without departing from the spirit and scope of the invention as defined by the following claims.

What is claimed is:

1. A railway car underframe comprising:

a pair of end sills cooperating with a pair of side sills to form a generally rectangular configuration;

a plurality of cross bearers extending between the side sills and spaced laterally from each other between the end sills;

a center sill extending between the end sills along a center line of the rectangular configuration and disposed above at least one of the plurality of cross bearers;

a pair of coupler assemblies disposed on respective ends of the rectangular configuration;

a pair of railway trucks disposed at respective ends of the generally rectangular configuration proximate the end sills;

a body bolster extending between the center sill and the side sills above each of the railway trucks;

a plurality of stringer support spacer beams disposed on at least one of the plurality of cross bearers; and the stringer support spacer beams operable to provide support to a plurality of floor stringers disposed thereon.

2. A railway car underframe comprising:

a pair of end sills cooperating with a pair of side sills to form a generally rectangular configuration;

a plurality of cross bearers extending between the side sills and spaced laterally from each other between the end sills;

a center sill extending between the end sills along a center line of the rectangular configuration and disposed on and above at least one of the plurality of cross bearers;

a pair of coupler assemblies disposed on respective ends of the rectangular configuration;

a pair of railway trucks disposed at respective ends of the generally rectangular configuration proximate the end sills;

a body bolster extending between the center sill and the side sills above each of the railway trucks;

a plurality of floor support brackets disposed on the center sill and on the side sills; and the floor support brackets operable to provide support to respective ends of a nailable metal floor plank positioned thereon.

3. A railway car underframe comprising:

a pair of end sills cooperating with a pair of side sills to form a generally rectangular configuration;

a plurality of cross bearers extending between the side sills and spaced laterally from each other between the end sills;

a center sill extending between the end sills along a center line of the rectangular configuration and disposed on and above at least one of the plurality of cross bearers;

a pair of coupler assemblies disposed on respective ends of the rectangular configuration;

a pair of railway trucks disposed at respective ends of the generally rectangular configuration proximate the end sills;

a body bolster extending between the center sill and the side sills above each of the railway trucks;

a strength plate disposed along at least a portion of the center sill; and the strength plate operable to engage one end of a nailable metal floor plank disposed proximate the center sill.

4. A railway car underframe comprising:

a pair of end sills cooperating with a pair of side sills to form a generally rectangular configuration;

a plurality of cross bearers extending between the side sills and spaced laterally from each other between the end sills;

a center sill extending between the end sills along a center line of the rectangular configuration and disposed on and above at least one of the plurality of cross bearers;

a pair of coupler assemblies disposed on respective ends of the rectangular configuration;

a pair of railway trucks disposed at respective ends of the generally rectangular configuration proximate the end sills;

a body bolster extending between the center sill and the side sills above each of the railway trucks; and a side sill channel operably coupled to each of the side sills.

5. A railway car comprising:

first and second side sills;

first and second end sills disposed generally normal proximate respective ends of the first and second side sills to form a generally rectangular configuration;

a center sill disposed along a longitudinal center line of the rectangular configuration;

a plurality of cross bearers positioned beneath the center sill and extending between the side sills and spaced laterally from each other between the end sills;

respective railway trucks disposed proximate the first and second end sills;

a body bolster extending between the center sill and the first and second side sills above each of the respective railway trucks;

a bolster plate disposed above each body bolster and extending between the side sills;

a plurality of wheel pans attached to and extending horizontally from each body bolster and sized to extend over the respective railway trucks, the plurality of wheel pans extending generally parallel to the longitudinal centerline;

a first plurality of floor stringers extending between the first and second end sills and the wheel pans and spaced laterally from each other between the center sill and the first and second side sills;

a second plurality of floor stringers extending longitudinally between the wheel pans above the respective railway trucks and spaced laterally from each other between the center sill and the first and second side sills;

the second plurality of floor stringers disposed on at least one cross bearer;

a plurality of floor planks extending between the center sill and the first and second side sills, between the first and second end sills; and a pair of coupler assemblies disposed proximate the first and second end sills.

6. The railway car of claim 5 further comprising at least one of the plurality of cross bearers disposed below the center sill and extending between the first and second side sills.

7. The railway car of claim 5 further comprising:

an offset disposed on respective ends of each of the plurality of floor planks; and a strength plate disposed above at least a portion of the center sill operable to engage the offset in the plurality of floor planks disposed proximate the center sill.

8. The railway car of claim 5 further comprising:

a plurality of floor support brackets disposed on the center sill and on the first and second side sills; and the floor support brackets operable to engage respective ends of the floor planks.

9. The railway car of claim 5 further comprising a side sill channel disposed on the first and second side sills.

10. The railway car of claim 5 further comprising a plurality of boxcar walls operably coupled to the side sills and the end sills.

11. The railway car of claim 5 wherein the floor planks comprise nailable metal floor planks.

12. The railway car comprising:

first and second side sills;

first and second end sills disposed generally normal proximate respective ends of the first and second side sills to form a generally rectangular configuration;

a center sill disposed along a longitudinal center line of the rectangular configuration;

a plurality of cross bearers extending between the side sills and spaced laterally from each other between the end sills;

a stringer support spacer beam disposed on at least one of the cross bearers disposed below the center sill and extending between the first and second side sills;

respective railway trucks disposed proximate the first and second end sills;

a body bolster extending between the center sill and the first and second side sills above each of the respective railway trucks;

a bolster plate disposed above each body bolster and extending between the side sills;

a plurality of wheel pans attached to and extending horizontally from each body bolster and sized to extend over the respective railway trucks;

a first plurality of floor stringers extending between the first and second end sills and the wheel pans and spaced laterally from each other between the center sill and the first and second side sills;

a second plurality of floor stringers extending longitudinally between the wheel pans above the respective railway trucks and spaced laterally from each other between the center sill and the first and second side sills;

the second plurality of floor stringers disposed on at least one cross bearer;

a plurality of floor planks extending between the center sill and the first and second side sills between the first and second end sills;

a pair of coupler assemblies disposed proximate the first and second end sills; and comprising at least one of the plurality of cross bearers disposed below the center sill and extending between the first and second side sills.

13. A railway car comprising:

a pair of side sills and a pair of end sills cooperating with the side sills to form a generally rectangular configuration;

a plurality of cross bearers extending between the side sills and spaced laterally from each other between the end sills;

a center sill extending between the end sills on a longitudinal center line of the rectangular configuration and disposed on one or more of the plurality of cross bearers;

a plurality of floor stringers extending between the end sills and spaced laterally from each other between the center sill and the side sills;

one or more of the plurality of floor stringers disposed on one or more of the plurality of cross bearers; and a floor system disposed on the plurality of floor stringers.

14. The railway car of claim 13 further comprising:

a pair of railway trucks disposed proximate each end sill;

a body bolster extending between the center sill and the side sills above each of the railway trucks;

a bolster plate disposed above each body bolster and extending between at least the center sill and the side sills; and a plurality of wheel pans attached to and extending horizontally from each body bolster with the wheel pans sized to extend over the respective railway trucks.

15. The railway car of claim 14 further comprising:

a plurality of nailable metal floor planks disposed on the plurality of floor stringers;

the nailable metal floor planks extending between the side sills and between the wheel pans and the center sill and between the side sills and the wheel pans; and the nailable metal floor planks spaced laterally from each other between the end sills and the wheel pans and between the wheel pans above the railway trucks.

16. The railway car of claim 13 further comprising:

one or more stringer support spacer beams disposed on one or more of the plurality of cross bearers; and one or more of the plurality of floor stringers disposed on one or more of the stringer support spacer beams.

17. The railway car of claim 13 further comprising:

a plurality of nailable metal floor planks disposed on the plurality of floor stringers; and the plurality of nailable metal floor planks extending between the center sill and each side sill and spaced laterally from each other between the end sills.

18. The railway car of claim 15 further comprising:

a strength plate extending between the end sills along the center sill; and the strength plate operable to engage offsets included in a first end of the nailable metal floor planks disposed proximate the center sill.

19. The railway car of claim 13 further comprising a plurality of boxcar walls operably coupled to the side sills and the end sills.

* * * * *